United States Patent [19]

Wu

[11] Patent Number: 4,912,272

[45] Date of Patent: Mar. 27, 1990

[54] LUBRICANT BLENDS HAVING HIGH VISCOSITY INDICES

[75] Inventor: Margaret M. Wu, Belle Mead, N.J.

[73] Assignee: Mobil Oil Corporation, New York, N.Y.

[21] Appl. No.: 210,454

[22] Filed: Jun. 23, 1988

[51] Int. Cl.[4] ..... C07C 2/08

[52] U.S. Cl. ..... 585/10; 585/12

[58] Field of Search ..... 585/10, 12

[56] References Cited

U.S. PATENT DOCUMENTS

| | | | |
|---|---|---|---|
| 2,895,915 | 7/1959 | Hewett et al. | 585/10 |
| 3,113,167 | 12/1963 | Sauer | 585/10 |
| 3,637,503 | 1/1972 | Giannetti | 585/10 |
| 3,795,616 | 3/1974 | Heilman et al. | 585/10 |
| 3,965,018 | 6/1976 | Heilman et al. | 585/10 |
| 4,018,695 | 4/1977 | Heilman et al. | 585/10 |
| 4,282,392 | 8/1981 | Cupples et al. | 585/10 |
| 4,587,368 | 5/1986 | Pratt | 585/10 |
| 4,613,712 | 9/1986 | Bridger | 585/10 |
| 4,827,064 | 5/1989 | Wu | 585/10 |

FOREIGN PATENT DOCUMENTS

| | | | |
|---|---|---|---|
| 0862191 | 3/1961 | United Kingdom | 585/10 |
| 0940143 | 10/1963 | United Kingdom | 585/10 |
| 1088907 | 10/1967 | United Kingdom | 585/10 |
| 1264981 | 2/1972 | United Kingdom | 585/10 |
| 2024846 | 1/1980 | United Kingdom | 585/10 |

OTHER PUBLICATIONS

Journal of Catalysis 88, 424–430 (1984) Weiss & Krauss

*Primary Examiner*—William R. Dixon, Jr.
*Assistant Examiner*—Rhonda R. Brown
*Attorney, Agent, or Firm*—Alexander J. McKillop; Charles J. Speciale; L. G. Wise

[57] ABSTRACT

Novel lubricant mixtures are disclosed having unexpectedly high viscosity indices. The mixtures are blends of high viscosity index polyalphaolefins prepared with activated chromium on silica catalyst and polyalphaolefins prepared with BF3, aluminum chloride, or Ziegler-type catayst. Superior blends are also prepared from HVIXPAO with mineral oil and/or other synthetic liquid lubricants.

23 Claims, No Drawings

LUBRICANT BLENDS HAVING HIGH VISCOSITY INDICES

This invention relates to novel lubricant compositions exhibiting superior lubricant properties such as high viscosity index More particularly, the invention relates to novel lubricant blends of high viscosity index polyalphaolefins lubricant basestock with conventional polyalphaolefins or mineral oil lubricant basestock.

BACKGROUND OF THE INVENTION

Synthetic polyalphaolefins (PAO) have found wide acceptability and commercial success in the lubricant field for their superiority to mineral oil based lubricants. In terms of lubricant properties improvement, industrial research effort on synthetic lubricants has led to PAO fluids exhibiting useful viscosities over a wide range of temperature, i.e., improved viscosity index (VI), while also showing lubricity, thermal and oxidative stability and pour point equal to or better than mineral oil. These relatively new synthetic lubricants lower mechanical friction, enhancing mechanical efficiency over the full spectrum of mechanical loads from worm gears to traction drives and do so over a wider range of ambient operating conditions than mineral oil. The PAO's are prepared by the polymerization of 1-alkenes using typically Lewis acid or Ziegler catalysts. Their preparation and properties are described by J. Brennan in Ind. Eng. Chem. Prod. Res. Dev. 1980, 19, pp 2–6, incorporated herein by reference in its entirety. PAO incorporating improved lubricant properties are also described by J. A. Brennan in U.S. Pat. Nos. 3,382,291, 3,742,082, and 3,769,363, also incorporated herein in their entirety by reference.

In accordance with customary practice in the lubricants art, PAO's have been blended with a variety of functional chemicals, oligomeric and high polymers and other synthetic and mineral oil based lubricants to confer or improve upon lubricant properties necessary for applications such as engine lubricants, hydraulic fluids, gear lubricants, etc. Blends and their components are described in Kirk-Othmer Encyclopedia of Chemical Technology, third edition, volume 14, pages 477–526, incorporated herein in its entirety by reference. A particular goal in the formulation of blends is the enhancement of viscosity index (VI) by the addition of VI improvers which are typically high molecular weight synthetic organic molecules. While effective in improving viscosity index, these VI improvers have been found to be dificient in that their very property of high molecular weight that makes them useful as VI improvers also confers upon the blend a vulnerability in shear stability during actual applications. This deficienty dramatically negates the range of application usefulness for many VI improvers. Their usefulness is further compromised by cost since they are relatively expensive polymeric substances that may constitute a significant proportion of the final lubricant blend. Accordingly, workers in the lubricant arts continue to search for lubricant blends with high viscosity index less vulnerable to degradation by shearing forces in actual applications while maintaining or improving other important properties such as thermal and oxidative stability.

Recently, a novel class of PAO lubricant compositions, herein referred to as HVI-PAO, exhibiting surprisingly high viscosity indices has been reported in patent application Ser. No. 946,226, filed Dec. 24, 1986.

These novel PAO lubricants are particularly characterized by low ratio of methyl to methylene groups, i.e., low branch ratios, as further described hereinafter. Their very unique structure provides new opportunities for the formulation of distinctly superior and novel lubricant blends.

Accordingly, it is an object of the present invention to provide novel lubricant compositions having improved viscosity index and shear stability.

It is a further object of the present invention to provide novel lubricant basestock blends from high viscosity index PAO (HVI-PAO) in conjunction with conventional PAO lubricant.

It is a further object of the present invention to provide novel lubricant compositions of high viscosity index PAO blends with mineral oil and/or conventional PAO whereby blends with superior viscosity indices and shear stability are produced.

SUMMARY OF THE INVENTION

Lubricant mixtures having surprisingly enhanced viscosity indices have been discovered comprising hydrogenated HVI-PAO having a branch ratio of less than 0.19 and liquid lubricant taken from the group consisting essentially of mineral oil, hydrogenated PAO, vinyl polymers, polyethers, polyfluorocarbons, polychlorofluorocarbons, polyesters, polycarbonates, silicones, polyurethanes, polyacetals, polyamides, polythiols, their co-polymers, terepolymers and mixtures thereof. Unexpectedly, when a low viscosity lubricant is blended with a high viscosity, high VI lubricant (HVI-PAO) produced from alphaolefins containing $C_6$ to $C_{20}$ atoms, the resulting blends have high viscosity indices and low pour points. The high viscosity index lubricant produced as a result of blending HVI-PAO and commercial PAO has much lower molecular weight than a conventional polymeric VI improver, thus offering the opportunity of greater shear stability.

The HVI-PAO having a branch ratio of less than 0.19 employed to prepare the blends of the present invention may be comprised of hydrogenated $C_{30}H_{62}$ hydrocarbons.

DESCRIPTION OF THE FIGURES

FIG. 1 is a comparison of VI vs. viscosity for blends, HVI-PAO and commercial PAO.

FIGS. 2 and 3 compares VI increases of blends of HVI-PAO with PAO vs. blending with commercial PAO.

FIG. 4 compares pour points of the blends.

FIG. 5 compares VI improvement for a 100" solvent neutral (zero pour) mineral oil with Commercial PAO (Mobil SHF-1001) vs. HVI-PAO.

FIG. 6 compares VI vs Viscosity for experimental blends with theoretical blending equations.

DETAILED DESCRIPTION OF THE INVENTION

The new synthetic lubricant basestocks of the instant invention are obtained by mixing a low viscosity lubricant basestock with HVI-PAO having a very high viscosity index. The low viscosity lubricant basestock, typically with a viscosity between 1.5 to 50 cS at 100° C., can be synthetic PAO, any conventional mineral oil lube stock derived from petroleum, or other synthetic lube stock. The high viscosity HVIPAO lubricant basestock, typically with a viscosity of 10 to 500 cS at 100° C. and a very high VI greater than 130, are produced from alphaolefins, 1-alkenes, of $C_6$ to $C_{20}$, either alone or in mixture, over an activated chromium on silica catalyst The high viscosity, high VI basestock, HVI-PAO, is further characterized by having a branch ratio of less than 0.19. When the high viscosity HVI-PAO basestock is blended with one or more lubricant basestock of low viscosity, the resultant lubricant has an unexpectedly high viscosity index and low pour points. The novel high V.I. PAO lubricants, HVI-PAO, with a branch ratio less than 0.19 are better blending components than the commercially available PAO often used to boost VI. Also, the HVI-PAO are superior to conventional VI improvers such as polybutene and polyacrylates since the blend produced therefrom is of much lower molecular weight thus offering improved shear stability. Also, the HVI-PAO is more oxidatively and hydrolytically stable than other VI improvers.

The HVI-PAO lubricant blending stock of the present invention may be prepared by the oligomerization of 1-alkenes as described hereinafter, wherein the 1-alkenes have 6 to 20 carbon atoms to give a viscosity range of 3–1000 cs at 100° C. The oligomers may be homopolymers or copolymers of such $C_6$–$C_{20}$ 1-alkenes, or physical mixtures of homopolymers and copolymers. They are characterized by their branch ratio of less than 0.19, pour point below −15° C., and are further characterized as having a number averaged molecular weight range from 300 to 70,000.

In the case of blends of PAO with HVI-PAO, the low viscosity basestock PAO component, or current PAO, is obtained from commercial sources such as MOBIL Chemical Co. in a viscosity range of 1.8 to 100 cs at 100° C. The commercial material is typically prepared by the oligomerization of 1-alkene in the presence of borontrifluoride, aluminum chloride or Ziegler catalyst and is characterized by having a branch ratio greater than 0.19 and viscosity indices significantly lower than HVI-PAO.

Other liquid lubricants useful as blending components with HVI-PAO include lubricant grade mineral oil from petroleum. Yet other useful HVI-PAO blending components include hydrogenated polyolefins such as polybutylene and polypropylene, liquid ethylene-propylene copolymer and the like; vinyl polymers such as polymethylmethacrylate and polyvinylchloride; polyethers such as polyethylene glycol, polypropylene glycol, polyethylene glycol methyl ether;polyflurocarbons such as polyetrafluorethylene and polychloroflurocarbons such as polyetrafluoroethylene; polyesters such as polyethyleneterephthalate and polyethyleneadipate; polycarbonates such as polybisphenol A carbonate; polyurethanes such as polyethylenesuccinoylcarbamate; silicones; polyacetals such as polyoxymethylene; polyamides such as polycaprolactam. The foregoing polymers include copolymer thereof of known composition exhibiting useful lubricant properties or conferring dispersant, anticorrosive or other properties on the blend. In all cases, blends may include other additives as described in the previously cited Kirk-Othmer reference including dispersants, detergents, viscosity index improvers, extreme pressure/antiwear additives, antioxidants, pour depressants, emulsifiers, demulsifiers, corrosion inhibitors, antirust inhibitors, antistaining additives, friction modifiers, and the like.

Unless otherwise noted, HVL-PAO, PAO and mineral oil based lubricants discussed herein preferably refer to hydrogenated materials in keeping with the practice of lubricant preparation well known to those skilled in the art. However, unhydrogenated high viscosity HVI-PAO with low unsaturation is sufficiently stable to use as lubricant basestock.

The following examples illustrate the application of the instant invention in the preparation of blends of high viscosity lubes with high viscosity indices by mixing HVI-PAO with conventional commercially available PAO. The samples used for blending experiment have the following viscometric properties:

| | Viscometric Properties | | |
|---|---|---|---|
| Sample | Vis cS 40° C. | Vis cS 100° C. | VI |
| A | 5238 | 483.1 | 271 |
| B | 1205.9 | 128.3 | 212 |
| C | 1336.2 | 139.4 | 214 |
| D | 1555.4 | 157.6 | 217 |
| EM 3002 | 5.22 | 1.75 | 99 |
| EM 3004 | 17.07 | 3.92 | 126 |
| Mobil SHF-61 | 29.53 | 5.64 | 133 |
| Mineral Oil | 21.32 | 4.19 | 97 |
| Mobil SHF-1001 | 1213.04 | 96.33 | 165 |
| Mineral Oil | 18.5/22.0 | 4.0 | 95 |

Sample A: A Cr (1 wt %) on silica catalyst, 4 grams, calcined at 600° C. with air and reduced with CO at 350° C., is mixed with 1-decene, 63 grams in a flask. The mixture is heated in an 100° C. oil bath under $N_2$ atmosphere for 16 hours. The lube product is obtained by filtration to remove catalyst and distilled to remove components boiling below 120° C. at 0.1 mmHg. The lube product yield is 92%.

Sample B: Similar to the previous example, except 1.7 grams of catalyst and 76 grams of 1-decene are heated to 25° C. The lube yield is 86%.

Sample C: An activated Cr (1 wt %) on silica catalyst, 3 grams, calcined at 500° C. with air and reduced with CO at 350° C., was packed in a stainless steel tubular reactor and heated to 119°+or −3° C. 1-Decene is fed through this reactor at 15.3 grams per hour at 200 psig. After about 2 hours on stream, 27.3 grams of crude product is collected. After distillation, 19 grams of lube product is obtained.

Sample D: In the same run as the previous example, 108 I0 grams of crude product is obtained after 15.5 hours on stream. After distillation, 86 grams of lube product is obtained.

PAO samples EM3002 and EM3004 are obtained commercially from Emery Chemical Co. Mobil SHF-61 and Mobil SHF-1001 are obtained from Mobil Chemical Co. The mineral oil used in the study is a 100″, solvent neutral mineral base stock, available from Mobil Oil Corporation, Product No. 71326-3.

In Tables 1–6 the results of blending experiments using the above samples are presented. In these blending experiments, the blend products were obtained by mixing proper amounts of the different feed stocks.

EXAMPLES

Example 1, (Table 1) 5.6 cs PAO (Mobil SHF-61) blended with sample B.

Example 2, (Table 2) 5.6 cs PAO (Mobil SHF-61) blended with sample A.

Example 3, (Table 3) 3.9 cs PAO (EM3004) blended with sample D.

Example 4, (Table 4) 1.8 cs PAO (EM3002) blended with sample C.

Example 5, (Table 7) 100" mineral oil blended with sample C.

Control Example A, (Table 5) 4 cs PAO blended with 100 cS PAO.

Control Example B, (Table 6) 5.6 cs PAO blended with 100 cS PAO.

Control Example C, (Table 8) Mineral oil blended with 100cs PAO(Mobil SHF-1001).

Data in Control Examples A and B were obtained from Uniroyal Chemical Co. sales brochure of Synthon PAO.

As shown in FIG. 1, when the HVI-PAO is used as blending components, the resulting blends at a specific viscosity have higher VI than the new PAO synthesized directly from 1-decene over $Cr/SiO_2$ catalyst or the PAO produced over acidic $BF_3$ or $AlCl_3$ catalysts. The VI advantages of the blends are illustrated as follows, comparing the VI's of the 10cs oils produced from various synthetic methods or from blending:

| 10 cs oil From | | | VI | VI Advantage |
|---|---|---|---|---|
| Direct synthesis (commercial) | | | 137 | 0 |
| Direct synthesis by $Cr/SiO_2$ | | | 163 | 26 |
| Blends of | PAO + | HVI-PAO | | |
| | 5.6 cS | 128 cS | 161 | 24 |
| | 5.6 cS | 483 cS | 165 | 28 |
| | 3.9 cS | 158 cS | 183 | 46 |
| | 1.8 cS | 139 cS | 220 | 83 |

As shown in FIG. 2 and 3, the resulting blends in Examples 1 to 3 with one specific viscosity also have higher VI than the blends produced in the Control Examples.

The blending products in Examples 1 to 4 have excellent low temperature properties. The pour points of the blends in Examples 1 to 4 are either lower or similar than the pour points of the current commercial PAO or the blends produced in Control Examples, as shown in FIG. 4.

Similarly, when a mineral lubricant as previously defined with viscosity at 100° C. of 4.2 cS and 97 VI, was blended with the high viscosity, high VI PAO (HVI-PAO), the VI of the resulting blends were improved (Example 5, Table 7). FIG. 5 shows that the VI of the blends in Example 5 is higher than the VI of the blends produced in Control Example C, when the mineral oil basestock is blended with a current commercial PAO Mobil SHF 1001 (Table 8). For example when 9.1 wt % of 157.6cS HVI-PAO with 217 VI is blended with mineral oil (97 VI) , the resulting lube had a VI and viscosities comparable to a commercial synthetic low viscosity PAO, Mobil SHF-61:

| | 9% HVI-PAO in Mineral Oil | Mobil SHF-61 |
|---|---|---|
| V @ 100° C., cS | 5.95 | 5.6 |
| VI | 134 | 133 |

When HVI-PAO is blended with either synthetic PAO or mineral lube, the resulting blends have unexpectedly high viscosity indices and excellent low temperature properties, such as low pour points. These very light VI blends can be used as a basestock for engine oils or hydraulic oils with little or no VI improver added.

TABLE 1

Viscosities and Pour Points of Blends 5.6 cs PAO + 128 cS HVI-PAO

| Wt % of HVI-PAO in 5.6 cs PAO | V 40° C., cS | V 100° C., cS | VI | PP °C. |
|---|---|---|---|---|
| 100 | 1205.92 | 128.34 | 212 | |
| 50.5 | 174.79 | 26.52 | 188 | −45 |
| | | | | −43 |
| 33.3 | 94.01 | 15.43 | 174 | −52 |
| | | | | −52 |
| 17.0 | 53.92 | 9.60 | 164 | −54 |
| | | | | −53 |
| 13.0 | 45.85 | 8.35 | 159 | |
| 9.1 | 40.36 | 7.42 | 151 | |
| 4.8 | 34.35 | 6.49 | 144 | |
| 2.4 | 31.59 | 6.06 | 141 | |
| 1.0 | 30.37 | 5.75 | 133 | |
| 0 | 29.53 | 5.64 | 13 | |

TABLE 2

Viscosities of Blends 5.6 cs PAO + 483.1 cS HVI-PAO

| Wt % of HVI-PAO in 5.6 cs PAO | V @ 40° C., cS | V @ 100° C., cS | VI |
|---|---|---|---|
| 100 | 5238.41 | 483.10 | 271 |
| 33.3 | 181.34 | 27.85 | 193 |
| 16.7 | 70.96 | 12.50 | 176 |
| 13.0 | 57.22 | 10.27 | 169 |
| 9.1 | 50.72 | 9.20 | 165 |
| 4.8 | 38.83 | 7.29 | 154 |
| 2.4 | 34.08 | 6.54 | 149 |
| 1 | 30.61 | 5.94 | 142 |
| 0 | 29.53 | 5.64 | 133 |

TABLE 3

Viscosities of Blends 3.9 cs PAO + 157.6 cS HVI-PAO

| Wt % of HVI-PAO in 3.9 cs PAO | V @ 40° C., cS | V @ 100° C., cS | VI | PP °C. |
|---|---|---|---|---|
| 100 | 1555.75 | 157.62 | 217 | |
| 66.7 | 288.91 | 41.85 | 201 | |
| 33.3 | 68.73 | 12.82 | 189 | −59 |
| 28.6 | 56.02 | 10.68 | 184 | |
| 23.1 | 45.19 | 8.82 | 179 | |
| 16.7 | 33.82 | 7.01 | 175 | |
| 9.1 | 24.92 | 5.40 | 160 | −64 |
| 4.8 | 20.82 | 4.59 | 140 | |
| 2.4 | 18.80 | 4.21 | 130 | |
| 1.0 | 17.68 | 4.02 | 127 | |
| 0.0 | 17.07 | 3.92 | 126 | −68 |

TABLE 4

Viscosities of Blends 1.75 cs PAO + 139.4 cS HVI-PAO

| Wt % of HVI-PAO in 1.75 cs PAO | V 40° C., cS | V 100° C., cS | VI | PP °C. |
|---|---|---|---|---|
| 100 | 1336.18 | 139.38 | 214 | |
| 50 | 61.03 | 12.96 | 218 | |
| 33.3 | 26.05 | 6.58 | 225 | −71 |
| | | | | −69 |
| 9.1 | 7.95 | 2.48 | 148 | −75 |
| | | | | −68 |
| 4.8 | 6.52 | 2.13 | 137 | |
| 2.4 | 5.83 | 1.92 | 115 | |
| 1.0 | 5.45 | 1.79 | 96 | |
| 0.0 | 5.22 | 1.75 | 99 | |

TABLE 5

Viscometrics of Blends of Low Viscosity Current PAO (PAO-4) with high viscosity current PAO (PAO-100)

| PAO-100 (wt %) | PAO-4 (wt %) | $KV_{100}$ °C. (cs) | POUR POINT °C. (°F.) | VI |
|---|---|---|---|---|
| 100 | 0 | 100 | −20 (−5) | 168 |
| 90 | 10 | 74 | −32 (−25) | 166 |
| 75 | 25 | 45 | −37 (−35) | 164 |
| 50 | 50 | 20 | −48 (−55) | 162 |
| 25 | 75 | 9 | −59 (−75) | 162 |
| 10 | 90 | 5.5 | <−59 (<−75) | 150 |
| 0 | 100 | 4 | −79 (−110) | 123 |

TABLE 6

Viscometrics of Blends of Low Viscosity Current PAO-6 with High Viscosity Current PAO (PAO-100)

| PAO-100 wt % | PAO-6 wt % | KV at 100° C. cS | VI |
|---|---|---|---|
| 10 | 90 | 8.15 | 146 |
| 25 | 75 | 12.61 | 152 |
| 67 | 33 | 40.0 | 159 |
| 100 | 0 | 100.0 | 168 |

TABLE 7

Viscosities of Blends 100″ Mineral Oil + 157.6 cs HVI-PAO

| Wt % of HVI-PAO in 100″ mineral oil | V @ 40° C., cS | V @ 100° C., cS | VI | PP °C. |
|---|---|---|---|---|
| 100 | 1555.75 | 157.62 | 217 | |
| 33.3 | 90.48 | 14.23 | 162 | |
| 9.1 | 31.79 | 5.95 | 134 | −20 |
| | | | | −19 |
| 4.8 | 26.15 | 5.04 | 121 | |
| 2.4 | 23.7 | 4.59 | 108 | |
| 1.0 | 22.27 | 4.35 | 102 | |
| 0.0 | 21.32 | 4.19 | 97 | |

TABLE 8

Viscosities of blends 100″ Mineral Oil + Mobil SHF 1001

| Wt % of Stock 751 in 100″ mineral oil | V @ 40 C,cS | V @ 100 C,cS | VI |
|---|---|---|---|
| 100 | 1214.04 | 96.33 | 165 |
| 90 | 823.68 | 72.26 | 162 |
| 75 | 450.88 | 46.15 | 159 |
| 70 | 371.06 | 40.38 | 160 |
| 50 | 172.62 | 21.87 | 151 |
| 30 | 78.25 | 11.8 | 144 |
| 0 | 21.32 | 4.19 | 97 |

It has been found that empirical blending equations such as that given in Appendix 2 of ASTM D341-77 "Viscosity-Temperature Charts for Liquid Petroleum Products" fail to predict the viscosityVI relationship found in the novel blends reported herein. While not accurately predicting the viscometrics of the novel blends of the instant invention, the following equation reported by M. Horio, T. Fujii and S. Onogi (J. Phys. Chem., 68 (1964) provides the closest approximation:

$$\log A = w_B \log B + w_C \log C$$

where A is the blend viscosity, B and C are the dynamic viscosities of components B and C, and $w_A$ and $w_B$ are weight fractions. FIG. 6 compares VI and viscosity for experimental blends with curves developed from known blending equations.

The following Examples serve to further illustrate the preparation and properties of HVI-PAO employed in the unique blends of the instant invention and methods of preparing the catalyst used in the preparation of HVI-PAO. By the following methods, HVI-PAO with a weight average molecular weight between 300 and 150,000; number average molecular weight between 300 and 70,000; molecular weight distribution between and five can be produced with VI greater than 130 and pour point below −15° C. Preferably, the weight average molecular is between 330 and 90,000; number average molecular weight is between 300 and 30,000; and molecular weight distribution is between 1.01 and 3.

EXAMPLE 6

Catalyst Preparation and Activation Procedure 1.9 grams of chromium (II) acetate $Cr_2$acetate $Cr_2(OCOCH_3)_4.2H_2O$ (5.05 mmole) (commercially obtained) is dissolved in 50 cc of hot acetic acid. Then 50 grams of a silica gel of 8–12 mesh size, a surface area of 300 $m^2/g$, and a pore volume of 1 cc/g, also is added. Most of the solution is absorbed by the silica gel. The final mixture is mixed for half an hour on a rotavap at room temperature and dried in an open dish at room temperature. First, the dry solid (20 g) is purged with $N_2$ at 250° C. in a tube furnace. The furnace temperature is then raised to 400° C. for 2 hours. The temperature is then set at 600° C. with dry air purging for 16 hours. At this time the catalyst is cooled down under $N_2$ to a temperature of 300° C. Then a stream of pure CO (99.99% from Matheson) is introduced for one hour. Finally, the catalyst is cooled down to room temperature under $N_2$ and ready for use.

EXAMPLE 7

The catalyst prepared in Example 6 (3.2 g is packed in a ⅜″ stainless steel tubular reactor inside an $N_2$ blanketed dry box. The reactor under $N_2$ atmosphere is then heated to 150° C. by a single-zone Lindberg furnace. Prepurified 1-hexene is pumped into the reactor at 140 psi and 20 cc/hr. The liquid effluent is collected and stripped of the unreacted starting material and the low boiling material at 0.05 mm Hg. The residual clear, colorless liquid has viscosities and VI's suitable as a lubricant base stock.

| Sample | Prerun | 1 | 2 | 3 |
|---|---|---|---|---|
| T.O.S*., hr. | 2 | 3.5 | 5.5 | 21.5 |
| Lube Yield, wt % | 10 | 41 | 74 | 31 |
| Viscosity, cS, at | | | | |
| 40° C. | 208.5 | 123.3 | 104.4 | 166.2 |
| 100° C. | 26.1 | 17.1 | 14.5 | 20.4 |
| VI | 159 | 151 | 142 | 143 |

*time on stream

EXAMPLE 8

Similar to Example 7, a fresh catalyst sample is charged into the reactor and 1-hexene is pumped to the reactor at 1 atm and 10 cc per hour. As shown below, a lube of high viscosities and high VI's is obtained. These runs show that at different reaction conditions, a lube product of high viscosities can be obtained.

| Sample | A | B |
|---|---|---|
| T.O.S., hrs. | 20 | 44 |
| Temp., °C. | 100 | 50 |
| Lube Yield, % | 8.2 | 8.0 |
| Viscosities, cS at | | |

-continued

| Sample | A | B |
|---|---|---|
| 40° C. | 13170 | 19011 |
| 100° C. | 620 | 1048 |
| VI | 217 | 263 |

EXAMPLE 9

A commercial chrome/silica catalyst which contains 1% Cr on a large-pore volume synthetic silica gel is used. The catalyst is first calcined with air at 800° C. for 16 hours and reduced with CO at 300° C. for 1.5 hours. Then 3.5 g of the catalyst is packed into a tubular reactor and heated to 100° C. under the $N_2$ atmosphere. 1-Hexene is pumped through at 28 cc per hour at 1 atmosphere. The products are collected and analyzed as follows:

| Sample | C | D | E | F |
|---|---|---|---|---|
| T.O.S., hrs. | 3.5 | 4.5 | 6.5 | 22.5 |
| Lube Yield, % | 73 | 64 | 59 | 21 |
| Viscosity, cS, at | | | | |
| 40° C. | 2548 | 2429 | 3315 | 9031 |
| 100° C. | 102 | 151 | 197 | 437 |
| VI | 108 | 164 | 174 | 199 |

These runs show that different Cr on a silica catalyst are also effective for oligomerizing olefins to lube products.

EXAMPLE 10

As in Example 9, purified 1-decene is pumped through the reactor at 250 to 320 psi. The product is collected periodically and stripped of light products boiling points below 650° F. High quality lubes with high VI are obtained (see following table).

| Reaction Temp. °C. | WHSV g/g/hr | Lube Product Properties V at 40° C. cS | V at 100° C. cS | VI |
|---|---|---|---|---|
| 120 | 2.5 | 1555.4 | 157.6 | 217 |
| 135 | 0.6 | 389.4 | 53.0 | 202 |
| 150 | 1.2 | 266.8 | 36.2 | 185 |
| 166 | 0.6 | 67.7 | 12.3 | 181 |
| 197 | 0.5 | 21.6 | 5.1 | 172 |

EXAMPLE 11

Similar catalyst is , used in testing 1-hexene oligomerization at different temperature. 1-Hexene is fed at 28 cc/hr and at 1 atmosphere.

| Sample | G | H |
|---|---|---|
| Temperature, °C. | 110 | 200 |
| Lube Yield, wt. % | 46 | 3 |
| Viscosities, cS at | | |
| 40° C. | 3512 | 3760 |
| 100° C. | 206 | 47 |
| VI | 174 | 185 |

EXAMPLE 12

1.5 grams of a similar catalyst as prepared in Example 9 is added to a two-neck flask under $N_2$ atmosphere. Then 25 g of 1-hexene is added. The slurry is heated to 55° C. under $N_2$ atmosphere for 2 hours. Then some heptane solvent is added and the catalyst is removed by filtration. The solvent and unreacted starting material is stripped off to give a viscous liquid with a 61% yield. This viscous liquid has viscosities of 1536 and 5182I cS at 100° C. and ° C., respectively. This example demonstrates that the reaction can be carried out in a batch operation.

The 1-decene oligomers as described below are synthesized by reacting purified 1-decene with an activated chromium on silica catalyst. The activated catalyst is prepared by calcining chromium acetate (1 or 3% Cr) on silica gel at 500°–800° C. for 16 hours, followed by treating the catalyst with CO at 300°–350° C. for 1 hour. 1-Decene is mixed with the activated catalyst and heated to reaction temperature for 16–21 hours. The catalyst is then removed and the viscous product is distilled to remove low boiling components at 150° C./0.1 mmHg.

Reaction conditions and results for the lube synthesis are summarized below:

TABLE 9

| Example NO. | Cr on Silica | Calcination Temp. | Treatment Temp. | 1-decene/ Catalyst Ratio | Lube Yld |
|---|---|---|---|---|---|
| 13 | 3 wt % | 700° C. | 350° C. | 40 | 90% |
| 14 | 3 | 700 | 350 | 40 | 90 |
| 15 | 1 | 500 | 350 | 45 | 86 |
| 16 | 1 | 600 | 350 | 16 | 92 |

BRANCH RATIOS AND LUBE PROPERTIES OF EXAMPLES 13–16 ALPHA OLEFIN OLIGOMERS

TABLE 10

| Example No. | Branch $CH_3$ Ratios $CH_2$ | $V_{40}$ °C. | $V_{100}$ °C. | VI |
|---|---|---|---|---|
| 13 | 0.14 | 150.5 | 22.8 | 181 |
| 14 | 0.15 | 301.4 | 40.1 | 186 |
| 15 | 0.16 | 1205.9 | 128.3 | 212 |
| 16 | 0.15 | 5238.0 | 483.1 | 271 |

EXAMPLE 17

A commercial Cr on silica catalyst which contains 1% Cr on a large pore volume synthetic silica gel is used. The catalyst is first calcined with air at 700° C. for 16 hours and reduced with CO at 350° C. for one to two hours. 1.0 part by weight of the activated catalyst is added to 1-decene of 200 parts by weight in a suitable reactor and heated to 185° C. 1-Decene is continuously fed to the reactor at 2–3.5 parts/minute and 0.5 parts by weight of catalyst is added for every 100 parts of 1-decene feed. After 1200 parts of 1-decene and 6 parts of catalyst are charged, the slurry is stirred for 8 hours. The catalyst is filtered and light product boiled below 150° C. @0.mm Hg is stripped. The residual product is hydrogenated with a Ni on Kieselguhr catalyst at 200° C. The finished product has a viscosity at 100° C. of 18.5 cs, VI of 165 and pour point of −55° C.

EXAMPLE 18

Similar as in Example 17, except reaction temperature is 125° C. The finished product has a viscosity at 100° C. of 145 cs, VI of 214, pour point of -40° C.

EXAMPLE 19

Similar as in Example 17, except reaction temperature is 100° C. The finished product has a viscosity at 100° C. of 298 cs, VI of 246 and pour point of −32° C.

The final lube products in Example 17 to 19 contain the following amounts of dimer and trimer and isomeric distribution (distr.).

| Example | 17 | 18 | 19 |
|---|---|---|---|
| Vcs @ 100° C. | 18.5 | 145 | 298 |
| VI | 165 | 214 | 246 |
| Pour Point, °C. | −55° C. | −40° C. | −32 |
| wt % dimer | 0.01 | 0.01 | 0.027 |
| | wt % isomeric distr. dimer | | |
| n-eicosane | 51% | 28% | 73% |
| 9-methylnonacosane | 49% | 72% | 27% |
| wt % trimer | 5.53 | 0.79 | 0.27 |
| | wt % isomeric distr. trimer | | |
| 11-octyldocosane | 55 | 48 | 44 |
| 9-methyl,11-octyl-heneicosane | 35 | 49 | 40 |
| others | 10 | 13 | 16 |

The following table summaries the molecular weights and distributions of Examples 16 to 18.

| Examples | 16 | 17 | 18 |
|---|---|---|---|
| V @ 100° C., cs | 18.5 | 145 | 298 |
| VI | 165 | 214 | 246 |
| number-averaged molecular weights, $MW_n$ | 1670 | 2062 | 5990 |
| weight-averaged molecular weights, $MW_w$ | 2420 | 4411 | 13290 |
| molecular weight distribution, MWD | 1.45 | 2.14 | 2.22 |

Under similar conditions, HVI-PAO product with viscosity as low as 3 cs and a high as 1000 cs, with VI between 130 and 280, can be produced.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A lubricant mixture having enhanced viscosity index comprising, hydrogenated polyalpha-olefin having a branch ratio of less than 0.19 and pour point below −15° C. and liquid lubricant taken from the group consisting of mineral oil, hydrogenated polyolefins comprising polypropylene, polyisobutylene and polyalpha-olefins with a branch ratio greater than 0.19, polyethers, vinyl polymers, polyfluorocarbons, polychlorofluorocarbons, polyesters, polycarbonates, polyurethanes, polyacetals, polyamides, polythiols, their copolymers, terpolymers and mixtures thereof.

2. The lubricant mixture of claim 1 wherein said poly alpha-olefin has a weight average molecular weight between 300 and 150,000; number average molecular weight between 300 and 70,000; molecular weight distribution between 1 and 5 and; viscosity index greater than 130.

3. The lubricant mixture of claim 2 wherein said average molecular weight is between 330 and 90,000; said number average molecular weight is preferably between 300 and 30,000 and; said molecular weight distribution is preferably between 1.01 and 3.

4. The lubricant mixture of claim 1 wherein said hydrogenated polyalpha-olefin comprises the hydrogenated polymeric or copolymeric residue of 1-alkenes taken from the group consisting of $C_6$ to $C_{20}$ 1-alkenes.

5. The lubricant mixture of claim 1 wherein said poly alpha-olefin comprises polydecene.

6. The lubricant mixture of claim 5 wherein said polydecene has a VI greater than 130 and a pour point below −15° C.

7. The lubricant mixture of claim 1 wherein said material oil comprises petroleum hydrocarbons, said hydrogenated polyolefins comprise polyisobutylene, polypropylene and polyalpha-olefins with a branch ratio greater than 0.19, said vinyl polymers comprise polymetylmethacrylate and polyvinylchloride, said polyethers comprise polyethylene glycol, said polyfluorcarbons comprise polyfluoroethylene, said polychlorofluorocarbons comprise polychlorofluoroethylene, said polyesters comprise polyethyleneterephthate and polyethyleneadipate, said polycarbonates comprise polybisphenol A carbonate, said polyurethanes comprise polyethylenesuccinoylcarbamate, said polyacetals comprise polyoxymethylene and said polyamides comprise polycaprolactam.

8. A lubricant mixture according to claim 1 wherein said mixture comprises between 1 and 99 weight percent of said polyalpha-olefin with a kinematic viscosity at 100° C. of between 3 and 1000 centistokes.

9. The lubricant mixture of claim 8 wherein said poly alpha-olefin has a kinematic viscosity of between 4–20 cs at 100° C. and comprises about 20 weight percent of said mixture.

10. A lubricant mixture having enhanced viscosity index comprising, hydrogenated $C_{30}H_{62}$ hydrocarbons having a branch ratio of less than 0.19 and pour point below −15° C. and liquid lubricant taken from the group consisting of mineral oil, hydrogenated polyolefins comprising polypropylene, polyisobutylene and polyalphaolefins with a branch ratio greater than 0.19, vinylpolymers, polyfluorocarbon, polychlorofluorocarbons, polyesters, polycalonates, polyurethanes, polyacetals, polyamides, polythiols, their copolymers, terpolymers and mixtures thereof.

11. The lubricant mixture of claim 10 wherein said polyolefins comprise polyalpha-olefins having a branch ratio of greater than 0.19.

12. The lubricant mixture of claim 11 wherein said polyalpha-olefin having a branch ratio greater than 0.19 comprises polydecene.

13. The lubricant mixture of claim 10 wherein said $C_{30}H_{62}$ hydrocarbons have a refractive index of 1.4396 at 60° C., V.I greater than 130 and kinematic viscosity of 3–4 cs at 100° C.

14. The lubricant mixture according to claim 10 wherein said $C_{30}H_{62}$ hydrocarbons comprise between 0.01 and 99 weight percent of said mixture and said mixture has a VI greater than 130.

15. The mixture of claim 14 wherein said $C_{30}H_{62}$ hydrocarbons comprise about 0.1 to 20 weight percent of the mixture.

16. The mixture of claim 10 wherein said $C_{30}H_{62}$ hydrocarbons comprise a mixture of 11-octyldocosane and methyl,11-octylheneicosane in a ratio between 1:10 and 10:1.

17. The mixture of claim 10 wherein said $C_{30}H_{62}$ hydrocarbon comprises 11-octyldocosane.

18. The mixture of claim 7 wherein said polyalpha-olefin having a branch ratio greater than 0.19 comprises the oligomerization product of 1-alkene catalysed by acid catalyst.

19. The mixture of claim 18 wherein said acid catalyst is $BF_3$ or $AlCl_3$.

20. The mixture of claim 18 wherein said 1-alkene is 1-decene and said oligomerization product is polyalpha-decene.

21. A lubricant mixture according to claim 1 wherein said hydrogenated polyalpha-olefin is the oligomerization product of the oligomerization of 1-alkene in contact with reduced chromium oxide catalyst supported on silica.

22. The lubricant mixture of claim 21 wherein said 1-alkene is 1-decene.

23. The lubricant mixture of claim 1 further comprising lubricant additives taken from the group consisting, of antioxidants, dispersants, extreme pressure additives, friction modifiers, detergents, corrosion inhibitors, antifoamants and VI improvers.

* * * * *